US012723316B2

(12) United States Patent
Kim et al.

(10) Patent No.: US 12,723,316 B2
(45) Date of Patent: Sep. 1, 2026

(54) ELECTRODE FOR ELECTROLYSIS

(71) Applicant: LG Chem, Ltd., Seoul (KR)

(72) Inventors: Myung Hun Kim, Daejeon (KR); Yeon Yi Kim, Daejeon (KR); Hee Jun Eom, Daejeon (KR); Dong Chul Lee, Daejeon (KR)

(73) Assignee: LG Chem, Ltd., Seoul (KR)

( * ) Notice: Subject to any disclaimer, the term of this patent is extended or adjusted under 35 U.S.C. 154(b) by 799 days.

(21) Appl. No.: 17/621,966

(22) PCT Filed: Jan. 8, 2021

(86) PCT No.: PCT/KR2021/000240
§ 371 (c)(1),
(2) Date: Dec. 22, 2021

(87) PCT Pub. No.: WO2021/141435
PCT Pub. Date: Jul. 15, 2021

(65) Prior Publication Data

US 2022/0235477 A1 Jul. 28, 2022

(30) Foreign Application Priority Data

Jan. 9, 2020 (KR) ..... 10-2020-0003208

(51) Int. Cl.

| | |
|---|---|
| ***C25B 11/093*** | (2021.01) |
| ***C25B 1/04*** | (2021.01) |
| ***C25B 1/26*** | (2006.01) |
| ***C25B 11/052*** | (2021.01) |
| ***C25B 11/063*** | (2021.01) |

(52) U.S. Cl.
CPC ..... *C25B 11/093* (2021.01); *C25B 1/04* (2013.01); *C25B 1/26* (2013.01); *C25B 11/052* (2021.01); *C25B 11/063* (2021.01)

(58) Field of Classification Search
CPC ..... C25B 11/093; C25B 11/061; C25B 1/26; C25B 1/04; C25B 11/063
See application file for complete search history.

(56) References Cited

U.S. PATENT DOCUMENTS

| | | | | |
|---|---|---|---|---|
| 4,132,609 | A * | 1/1979 | Bush | C25D 7/065 204/206 |
| 4,900,419 | A | 2/1990 | Nishiki et al. | |
| 5,035,779 | A | 7/1991 | Nishiki et al. | |
| 6,312,571 | B1 | 11/2001 | Nara et al. | |
| 6,537,700 | B1 * | 3/2003 | Ovshinsky | H01M 4/364 252/521.2 |
| 2002/0081243 | A1 * | 6/2002 | He | B01J 37/0217 422/177 |
| 2005/0183952 | A1 * | 8/2005 | Shimamune | C23C 18/1216 204/290.01 |
| 2008/0230380 | A1 * | 9/2008 | Ohsaka | C25B 1/04 204/290.08 |
| 2009/0223815 | A1 | 9/2009 | Nara et al. | |
| 2013/0330651 | A1 * | 12/2013 | Thompsett | H01M 4/8657 429/525 |
| 2017/0198402 | A1 | 7/2017 | Takeuchi | |
| 2017/0247269 | A1 | 8/2017 | Tan et al. | |
| 2017/0297928 | A1 | 10/2017 | Iacopetti et al. | |
| 2018/0066371 | A1 | 3/2018 | Hong et al. | |
| 2019/0211464 | A1 * | 7/2019 | Jung | C23C 18/08 |

FOREIGN PATENT DOCUMENTS

| | | | | |
|---|---|---|---|---|
| AU | 2010305403 | A1 * | 3/2012 | C23C 18/08 |
| CN | 101029405 | A | 9/2007 | |
| CN | 103014751 | A | 4/2013 | |
| CN | 103924263 | A * | 7/2014 | |
| CN | 104894595 | A * | 9/2015 | Y02E 60/36 |
| CN | 107687002 | A | 2/2018 | |
| CN | 108998807 | A | 12/2018 | |
| CN | 109790634 | A | 5/2019 | |
| CN | 112342566 | A | 2/2021 | |
| EP | 3492631 | A1 | 6/2019 | |
| JP | S648288 | A | 1/1989 | |
| JP | H06033492 | B2 | 5/1994 | |
| JP | 2000239882 | A | 9/2000 | |
| JP | 2003277967 | A | 10/2003 | |
| JP | 2006193768 | A * | 7/2006 | |
| JP | 3941898 | B2 * | 7/2007 | |
| JP | 2009215580 | A | 9/2009 | |
| JP | 4927006 | B2 | 5/2012 | |
| JP | 5189781 | B2 | 4/2013 | |
| JP | 2015098058 | A1 | 7/2015 | |
| JP | 2017535675 | A | 11/2017 | |

(Continued)

OTHER PUBLICATIONS

Xiao et al. ("Electrodeposition of Ni(OH)2/NiOOH in the Presence of Urea for the Improved Oxygen Evolution," Electrochimica Acta 2015, 164(10), 196-202). (Year: 2015).*

Gunjakar et al. ("Chemical deposition of nanocrystalline nickel oxide from urea containing bath and its use in liquefied petroleum gas sensor," Sensors and Actuators B, 2008, 131, 356-361). (Year: 2008).*

Giordano et al. ("Metal Nitride and Metal Carbide Nanoparticles by a Soft Urea Pathway," Chem. Mater. 2009, 21, 5136-5144). (Year: 2009).*

Xie et al. ("One-pot construction of the carbon spheres embellished by layered double hydroxide with abundant hydroxyl groups for Pt-based catalyst support in methanol electrooxidation," J. Power Sources 2019, 420, 73-81). (Year: 2019).*

(Continued)

*Primary Examiner* — James Lin
*Assistant Examiner* — Kevin Sylvester
(74) *Attorney, Agent, or Firm* — Lerner David LLP

(57) ABSTRACT

The present disclosure relates to an electrode for electrolysis which includes a metal base layer, and a coating layer containing a ruthenium oxide, a cerium oxide, and a nickel oxide, wherein the coating layer is formed on at least one surface of the base layer. The electrode for electrolysis of the present disclosure is characterized by exhibiting excellent durability and improved overvoltage.

6 Claims, No Drawings

(56) References Cited

FOREIGN PATENT DOCUMENTS

| | | | | | |
|---|---|---|---|---|---|
| JP | 6481986 | B2 | | 3/2019 | |
| JP | 6506983 | B2 | | 4/2019 | |
| JP | 2019531407 | A | | 10/2019 | |
| KR | 101743935 | B1 | | 6/2017 | |
| KR | 20170077176 | A | | 7/2017 | |
| KR | 101894427 | B1 | | 9/2018 | |
| KR | 20190036711 | A | * | 4/2019 | ..... C25B 11/0489 |
| KR | 101950465 | B1 | | 5/2019 | |
| KR | 20200076275 | A | * | 6/2020 | ..... C25B 11/052 |

OTHER PUBLICATIONS

International Search Report for PCTKR2021000240 dated Apr. 14, 2021, 2 pgs.
Extended European Search Report including Written Opinion for Application No. 21738125.0 dated Sep. 13. 2022, pp. 1-8.
Search Report dated Dec. 21, 2023 from Office Action for Chinese Application No. 202180004167.3 issued Jan. 3, 2024. 2 pgs.

* cited by examiner

ELECTRODE FOR ELECTROLYSIS

CROSS-REFERENCE TO RELATED APPLICATIONS

This application claims priority from Korean Patent Application No. 10-2020-0003208, filed on Jan. 9, 2020, the disclosure of which is incorporated by reference herein.

TECHNICAL FIELD

The present invention relates to an electrode for electrolysis which may improve an overvoltage and a method of preparing the same.

BACKGROUND ART

Techniques for producing hydroxides, hydrogen, and chlorine by electrolysis of low-cost brine, such as sea water, are widely known. Such an electrolysis process is also called a chlor-alkali process, and may be referred to as a process that has already proven its performance and technical reliability in commercial operation for several decades.

With respect to the electrolysis of brine, an ion exchange membrane method, in which an ion exchange membrane is installed in an electrolytic bath to divide the electrolytic bath into a cation chamber and an anion chamber and brine is used as an electrolyte to obtain chlorine gas at an anode and hydrogen and caustic soda at a cathode, is currently the most widely used method.

The electrolysis of brine is performed by reactions as shown in the following electrochemical reaction formulae.

Anodic reaction: $2Cl^{-} \rightarrow Cl_2 + 2e^{-}$ ($E^0$=+1.36 V)

Cathodic reaction: $2H_2O + 2e^{-} \rightarrow 2OH^{-} + H_2$ ($E^0$=−0.83 V)

Total reaction: $2Cl^{-} + 2H_2O \rightarrow 2OH^{-} + Cl_2 + H_2$ ($E^0$=−2.19 V)

In the electrolysis of brine, an overvoltage of the anode, an overvoltage of the cathode, a voltage due to resistance of the ion exchange membrane, and a voltage due to a distance between the anode and the cathode must be considered for an electrolytic voltage in addition to a theoretical voltage required for brine electrolysis, and the overvoltage caused by the electrode among these voltages is an important variable.

Thus, methods capable of reducing the overvoltage of the electrode have been studied, wherein, for example, a noble metal-based electrode called a DSA (Dimensionally Stable Anode) has been developed and used as the anode and development of an excellent material having durability and low overvoltage is required for the cathode.

Stainless steel or nickel has mainly been used as the cathode, and, recently, in order to reduce the overvoltage, a method of using the stainless steel or nickel by coating a surface thereof with nickel oxide, an alloy of nickel and tin, a combination of activated carbon and oxide, ruthenium oxide, or platinum has been studied.

Also, in order to increase activity of the cathode by controlling a composition of an active material, a method of controlling the composition by using a platinum group element, such as ruthenium, and a lanthanide element, such as cerium, has also been studied. However, an overvoltage phenomenon has occurred, and a problem has occurred in which degradation due to reverse current occurs.

PRIOR ART DOCUMENT (Patent Document 1) JP2003-277967A

DISCLOSURE OF THE INVENTION

Technical Problem

An aspect of the present invention provides an electrode for electrolysis which may reduce an overvoltage by improving electrical properties of an electrode surface coating layer.

Technical Solution

According to an aspect of the present invention, there is provided an electrode for electrolysis which includes a metal base layer, and a coating layer containing a ruthenium oxide, a cerium oxide, and a nickel oxide, wherein the coating layer is formed on at least one surface of the base layer.

According to another aspect of the present invention, there is provided a method of preparing an electrode for electrolysis which includes the steps of: applying a coating composition on at least one surface of a metal base, and coating by drying and heat-treating the metal base on which the coating composition has been applied, wherein the coating composition includes a ruthenium precursor, a cerium precursor, and a nickel precursor.

Advantageous Effects

The present invention provides an electrode for electrolysis which may exhibit an excellent overvoltage as well as excellent basic durability while maintaining excellent electrical conductivity by containing a nickel oxide and a cerium oxide together in a coating layer.

MODE FOR CARRYING OUT THE INVENTION

Hereinafter, the present invention will be described in more detail.

It will be understood that words or terms used in the specification and claims shall not be interpreted as the meaning defined in commonly used dictionaries. It will be further understood that the words or terms should be interpreted as having a meaning that is consistent with their meaning in the context of the relevant art and the technical idea of the invention, based on the principle that an inventor may properly define the meaning of the words or terms to best explain the invention.

Electrode for Electrolysis

The present invention provides an electrode for electrolysis which includes a metal base layer, and a coating layer containing a ruthenium oxide, a cerium oxide, and a nickel oxide, wherein the coating layer is formed on at least one surface of the base layer.

The metal base may be nickel, titanium, tantalum, aluminum, hafnium, zirconium, molybdenum, tungsten, stainless steel, or an alloy thereof, and, among these metals, the metal base may preferably be nickel. In the electrode for electrolysis of the present invention, in a case in which the above-described types of metal bases are used, excellent durability and mechanical strength may be provided to the electrode.

In the electrode for electrolysis of the present invention, the coating layer contains a ruthenium oxide. The ruthenium oxide, as an active material, plays a role in providing a ruthenium element to the coating layer, wherein, in a case in which the ruthenium oxide is used in the coating layer of the electrode for electrolysis, a change in electrode performance over time is small while an overvoltage phenomenon is improved, and, subsequently, a separate activation process may be minimized. The ruthenium oxide includes all types of oxides in which the ruthenium element and an oxygen atom are bonded, and, particularly, may be a dioxide or a tetraoxide.

In the electrode for electrolysis of the present invention, the coating layer contains a cerium oxide, and the cerium oxide plays a role in providing a cerium element to the catalyst layer of the electrode for electrolysis. The cerium element provided by the cerium oxide may minimize a loss of the ruthenium element, as an active material in the coating layer of the electrode for electrolysis, during activation or electrolysis by improving the durability of the electrode for electrolysis.

Specifically, during the activation or electrolysis of the electrode for electrolysis, particles containing the ruthenium element in the catalyst layer become a metallic element without changing their structure or are partially hydrated and reduced to active species. In addition, since particles containing the cerium element in the catalyst layer change their structure into a needle shape, the particles act as a protective material that prevents physical detachment of the particles containing the ruthenium element in the catalyst layer, and, as a result, the durability of the electrode for electrolysis may be improved to prevent the loss of the ruthenium element in the coating layer. The cerium oxide includes all types of oxides in which the cerium element and an oxygen atom are bonded, and, particularly, may be an oxide of (II), (III) or (IV).

A molar ratio between the ruthenium element and the cerium element, which are contained in the coating layer, may be in a range of 100:2 to 100:40, for example, 100:5 to 100:20. In a case in which the molar ratio between the ruthenium element and the cerium element, which are contained in the coating layer, is within the above-described range, a balance between the durability and the electrical conductivity of the electrode for electrolysis may be excellent.

Since the above-described cerium oxide exhibits relatively low electrical conductivity, it is necessary to maintain an excellent balance between the durability improved by the cerium oxide and the electrical conductivity rather reduced by the cerium oxide. In the present invention, in a case in which a part of the cerium oxide in the coating layer is replaced with a nickel oxide having better electrical conductivity than the cerium oxide, since it is also excellent in terms of electrical conductivity while a durability improvement effect by the cerium oxide is maintained, it has been found that the above-described excellent balance between the durability and the electrical conductivity may be achieved. Thus, the coating layer of the electrode for electrolysis provided in the present invention contains a nickel oxide.

Since the nickel oxide exhibits relatively excellent electrical conductivity even in an oxide state, it has little effect on the durability while improving an overvoltage of the electrode for electrolysis. The nickel oxide includes all types of oxides in which a nickel element and an oxygen atom are bonded, and, particularly, may be a monoxide. Furthermore, since the nickel oxide may suppress the reduction in the electrical conductivity due to the cerium oxide by being contained together with the cerium oxide in the coating layer, the nickel oxide and the cerium oxide must be contained in a single coating layer at the same time. If, in a case in which a plurality of coating layers are used so that the nickel oxide and the cerium oxide are contained in the different coating layers from each other, the above-described advantages of the nickel oxide may not only not be obtained, but a delamination problem between the coating layers may also occur due to different physical characteristics of nickel and cerium.

Also, it may be considered to use an oxide of another metal known to have excellent electrical conductivity, for example, a metal oxide such as iron oxide, instead of the nickel oxide, but, in a case in which the above-described metal oxide is used instead of the nickel oxide, an effect of preventing the loss of the ruthenium element by the cerium oxide may be reduced. Specifically, if a coating composition including a ruthenium precursor, a nickel precursor, and a cerium precursor is applied to the base and then sintered, since the precursors are converted into a ruthenium oxide, a nickel oxide, and a cerium oxide, respectively, nickel does not interfere with the formation of the ruthenium oxide and the cerium oxide, but other metals, for example, strontium (Sr), barium (Ba), vanadium (V), and praseodymium (Pr) may reduce catalytic activity by forming hybrid oxides, such as $Sr_2CeO_4$, $BaCeO_3$, $CeVO_3$, and $Pr_3RuO$, respectively.

A molar ratio between the cerium element and the nickel element, which are contained in the coating layer, may be in a range of 10:90 to 90:10, for example, 25:75 to 75:25 or 50:50 to 75:25. In a case in which the molar ratio between the cerium element and the nickel element is within the above range, a balance between the durability improvement effect by the cerium oxide and the electrical conductivity improvement effect by the nickel oxide may be excellent.

Also, a molar ratio between the ruthenium element and the nickel element, which are contained in the coating layer, may be in a range of 100:2 to 100:20, for example, 100:5 to 100:15. An effect of improving the overvoltage by the nickel oxide may be maximized within the above-described range.

In the electrode for electrolysis of the present invention, the coating layer may further contain a platinum group oxide. The platinum group oxide refers to oxides of remaining elements other than the previously described ruthenium among platinum group elements, and, specifically, may be a rhodium oxide, palladium oxide, osmium oxide, iridium oxide or platinum oxide. The platinum group element provided by the platinum group oxide may act as an active material like the ruthenium element, and, in a case in which the platinum group oxide and the ruthenium oxide are included in the coating layer together, it may exhibit a better effect in terms of durability and overvoltage of the electrode. The platinum group oxide includes all types of oxides in which the platinum group element and an oxygen atom are bonded, and, particularly, may be a dioxide or a tetraoxide, and it is desirable that the platinum group oxide is a platinum oxide.

A molar ratio between the ruthenium element and the platinum group element, which are contained in the coating layer, may be in a range of 100:2 to 100:20, for example, 100:5 to 100:15. In a case in which the molar ratio between the ruthenium element and the platinum group element, which are contained in the coating layer, is within the above-described range, it is desirable in terms of improving the durability and overvoltage, wherein, in a case in which the platinum group element is contained less than the above range, the durability and overvoltage may degrade, and, in a case in which the platinum group element is contained more than the above range, it is disadvantageous in terms of economic efficiency.

Method of Preparing Electrode for Electrolysis

The present invention provides a method of preparing an electrode for electrolysis which includes the steps of: applying a coating composition on at least one surface of a metal base; and coating by drying and heat-treating the metal base on which the coating composition has been applied, wherein the coating composition includes a ruthenium precursor, a cerium precursor, and a nickel precursor.

In the method of preparing an electrode for electrolysis of the present invention, the metal base may be the same as the previously described metal base of the electrode for electrolysis.

In the method of preparing an electrode for electrolysis of the present invention, the coating composition may include a ruthenium precursor, a cerium precursor, and a nickel precursor. The precursors are converted into oxides by being oxidized in the heat treatment step after the coating.

The ruthenium precursor may be used without particular limitation as long as it is a compound capable of forming a ruthenium oxide, may be, for example, a hydrate, hydroxide, halide, or oxide of ruthenium, and may specifically be at least one selected from the group consisting of ruthenium hexafluoride ($RuF_6$), ruthenium(III) chloride ($RuCl_3$), ruthenium(III) chloride hydrate ($RuCl_3 \cdot xH_2O$), ruthenium(III) bromide ($RuBr_3$), ruthenium(III) bromide hydrate ($RuBr_3 \cdot xH_2O$), ruthenium iodide ($RuI_3$), and ruthenium acetate. When the ruthenium precursors listed above are used, the formation of the ruthenium oxide may be easy.

The cerium precursor may be used without particular limitation as long as it is a compound capable of forming a cerium oxide, may be, for example, a hydrate, hydroxide, halide, or oxide of a cerium element, and may specifically be at least one cerium precursor selected from the group consisting of cerium(III) nitrate hexahydrate ($Ce(NO_3)_3 \cdot 6H_2O$), cerium(IV) sulfate tetrahydrate ($Ce(SO_4)_2 \cdot 4H_2O$), and cerium(III) chloride heptahydrate ($CeCl_3 \cdot 7H_2O$). When the cerium precursors listed above are used, the formation of the cerium oxide may be easy.

The nickel precursor may be used without particular limitation as long as it is a compound capable of forming a nickel oxide, and, for example, the nickel precursor may be at least one selected from the group consisting of nickel(II) chloride, nickel(II) nitrate, nickel(II) sulfate, nickel(II) acetate, and nickel(II) hydroxide. When the nickel precursors listed above are used, the formation of the nickel oxide may be easy.

The coating composition may further include a platinum group precursor for forming a platinum group oxide in the coating layer. The platinum group precursor may be used without particular limitation as long as it is a compound capable of forming a platinum group oxide, may be, for example, a hydrate, hydroxide, halide, or oxide of a platinum group element, and may specifically be at least one platinum precursor selected from the group consisting of chloroplatinic acid hexahydrate ($H_2PtCl_6 \cdot 6H_2O$), diamine dinitro platinum ($Pt(NH_3)_2(NO)_2$), platinum(IV) chloride ($PtCl_4$), platinum(II) chloride ($PtCl_2$), potassium tetrachloroplatinate ($K_2PtCl_4$), and potassium hexachloroplatinate ($K_2PtCl_6$). When the platinum group precursors listed above are used, the formation of the platinum group oxide may be easy.

In the method of preparing an electrode for electrolysis of the present invention, the coating composition may further include an amine-based additive to provide a strong adhesion between the coating layer and the metal base. Particularly, the amine-based additive may improve a binding force between the ruthenium element, the cerium element, and the nickel element which are contained in the coating layer and may control an oxidation state of the particles containing the ruthenium element to prepare an electrode in a form more suitable for reaction.

The amine-based additive used in the present invention is particularly suitable for use in forming a coating layer due to its high solubility in water while having an amine group. The amine-based additive that may be used in the present invention includes melamine, ammonia, urea, 1-propylamine, 1-butylamine, 1-pentylamine, 1-heptylamine, 1-octylamine, 1-nonylamine, or 1-dodecylamine, and at least one selected from the group consisting thereof may be used.

In the electrode for electrolysis of the present invention, the ruthenium element of the ruthenium precursor and the amine-based additive, which are included in the coating layer, may be included in a molar ratio of 100:30 to 100:90, for example, 100:50 to 100:70. In a case in which the amine-based additive is included less than the above molar ratio range, an effect of improving the binding force by the additive is insignificant, and, in a case in which the amine-based additive is included more than the above molar ratio range, since precipitates may easily occur in a coating liquid, uniformity of the coating may not only be reduced, but the function of the ruthenium oxide may also be hindered.

In the method of preparing an electrode for electrolysis of the present invention, an alcohol-based solvent may be used as a solvent of the coating composition. In a case in which the alcohol-based solvent is used, dissolution of the above-described components is easy, and it is possible to maintain the binding force of each component even in the step of forming the coating layer after the application of the coating composition. Preferably, at least one of isopropyl alcohol and butoxyethanol may be used as the solvent, and, more preferably, a mixture of isopropyl alcohol and butoxyethanol may be used. In a case in which the isopropyl alcohol and the butoxyethanol are mixed and used, uniform coating may be performed in comparison to a case where the isopropyl alcohol and the butoxyethanol are used alone.

In the preparation method of the present invention, the preparation method may include a step of performing a pretreatment of the metal base before performing the coating.

The pretreatment may include the formation of irregularities on a surface of the metal base by chemical etching, blasting or thermal spraying.

The pretreatment may be performed by sandblasting the surface of the metal base to form fine irregularities, and performing a salt or acid treatment. For example, the pretreatment may be performed in such a manner that the surface of the metal base is blasted with alumina to form irregularities, immersed in a sulfuric acid aqueous solution, washed, and dried to form fine irregularities on the surface of the metal base.

The application is not particularly limited as long as the catalyst composition may be evenly applied on the metal base and may be performed by a method known in the art.

The application may be performed by any one method selected from the group consisting of doctor blading, die casting, comma coating, screen printing, spray coating, electrospinning, roller coating, and brushing.

The drying may be performed at 50° C. to 300° C. for 5 minutes to 60 minutes, and may preferably be performed at 50° C. to 200° C. for 5 minutes to 20 minutes.

When the above-described condition is satisfied, energy consumption may be minimized while the solvent may be sufficiently removed.

The heat treatment may be performed at 400° C. to 600° C. for 1 hour or less, and may preferably be performed at 450° C. to 550° C. for 5 minutes to 30 minutes.

When the above-described condition is satisfied, it may not affect strength of the metal base while impurities in the catalyst layer are easily removed.

The coating may be performed by sequentially repeating applying, drying, and heat-treating so that an amount of ruthenium oxide per unit area ($m^2$) of the metal base is 10 g or more. That is, after the catalyst composition is applied on at least one surface of the metal base, dried, and heat-treated, the preparation method according to another embodiment of the present invention may be performed by repeatedly applying, drying, and heat-treating the one surface of the metal base which has been coated with the first catalyst composition.

Hereinafter, the present invention will be described in more detail according to examples and experimental examples, but the present invention is not limited to these examples and experimental examples. The invention may, however, be embodied in many different forms and should not be construed as being limited to the embodiments set forth herein. Rather, these example embodiments are provided so that this description will be thorough and complete, and will fully convey the scope of the present invention to those skilled in the art.

Material

In the present example, a nickel mesh base (Ni purity of 99% or more, 200 μm) manufactured by Ildong Gold Mesh was used as a metal base, ruthenium(III) chloride hydrate ($RuCl_3 \cdot nH_2O$) was used as a ruthenium precursor, platinum (IV) chloride was used as a platinum group precursor, cerium(III) nitrate hexahydrate ($Ce(NO_3)_3 \cdot 6H_2O$) was used as a cerium precursor, and nickel chloride hexahydrate ($NiCl_2 \cdot 6H_2O$) was used as a nickel precursor. Urea was used as an amine-based additive.

Also, a mixture, in which isopropyl alcohol and 2-butoxyethanol were mixed in a volume ratio of 1:1, was used as a solvent for a coating composition.

Pretreatment of Metal Base

After a surface of the base was blasted with aluminum oxide (White alumina, F120) at a pressure of 0.4 MPa before forming a coating layer on the metal base, the base was put in a 5 M $H_2SO_4$ aqueous solution heated to 80° C., treated for 3 minutes, and then washed with distilled water to complete a pretreatment.

Example 1

After 1 g of a ruthenium precursor, 0.3135 g of a cerium precursor, 0.057 g of a nickel precursor, and 0.1625 g of a platinum group precursor were mixed in a molar ratio of 5:0.75:0.25:0.5 in 10 ml of the mixed solvent of the above materials such that a concentration of ruthenium was 100 g/L, 0.181 g of urea, as an amine-based additive, was added in a molar ratio of 3.13. The mixed solution was stirred at 50° C. overnight to prepare a coating composition. The coating composition was coated on the pretreated nickel base, the coated nickel base was put in a convection drying oven at 180° C. and dried for 10 minutes, and, thereafter, it was put in an electric heating furnace at 500° C. and was heat-treated for 10 minutes. After the above-described coating, drying, and heat treatment processes were repeated 9 times, a final electrode for electrolysis was finally prepared by performing a heat treatment in an electric heating furnace at 500° C. for 1 hour.

Example 2

An electrode for electrolysis was prepared in the same manner except that the molar ratio of the ruthenium precursor, the cerium precursor, the nickel precursor, and the platinum group precursor in Example 1 was 5:0.5:0.5:0.5.

Example 3

An electrode for electrolysis was prepared in the same manner except that the molar ratio of the ruthenium precursor, the cerium precursor, the nickel precursor, and the platinum group precursor in Example 1 was 5:0.25:0.75:0.5.

Example 4

An electrode for electrolysis was prepared in the same manner except that the molar ratio of the ruthenium precursor, the cerium precursor, the nickel precursor, and the platinum group precursor in Example 1 was 5:1:0.25:0.5.

Example 5

An electrode for electrolysis was prepared in the same manner except that the molar ratio of the ruthenium precursor, the cerium precursor, the nickel precursor, and the platinum group precursor in Example 1 was 5:1:0.25:0.

Comparative Example 1

An electrode for electrolysis was prepared in the same manner except that the molar ratio of the ruthenium precursor, the cerium precursor, the nickel precursor, and the platinum group precursor in Example 1 was 5:1:0:0.5.

Comparative Example 2

An electrode for electrolysis was prepared in the same manner except that the molar ratio of the ruthenium precursor, the cerium precursor, the nickel precursor, and the platinum group precursor in Example 1 was 5:1:0:0.

Molar ratios of components of electrode coating layers prepared in the examples and the comparative examples are summarized in Table 1 below.

TABLE 1

| | Example 1 | Example 2 | Example 3 | Example 4 | Example 5 | Comparative Example 1 | Comparative Example 2 |
|---|---|---|---|---|---|---|---|
| Ruthenium precursor | 5 | 5 | 5 | 5 | 5 | 5 | 5 |
| Cerium precursor | 0.75 | 0.5 | 0.25 | 1 | 1 | 1 | 1 |

TABLE 1-continued

| | Example 1 | Example 2 | Example 3 | Example 4 | Example 5 | Comparative Example 1 | Comparative Example 2 |
|---|---|---|---|---|---|---|---|
| Nickel precursor | 0.25 | 0.5 | 0.75 | 0.25 | 0.25 | 0 | 0 |
| Platinum group (platinum) precursor | 0.5 | 0.5 | 0.5 | 0.5 | 0 | 0.5 | 0 |

Experimental Example 1. Performance Check of the Prepared Electrodes for Electrolysis In order to confirm performances of the electrodes prepared in the examples and the comparative examples, a cathode voltage measurement test was performed using half cells in chlor-alkali electrolysis. A 32% NaOH aqueous solution was used as an electrolyte, a platinum (Pt) wire was used as a counter electrode, and a Hg/HgO electrode was used as a reference electrode. After the prepared electrode was put in the electrolyte, the electrode was activated at a constant current density of −0.62 A/cm$^2$ for 1 hour, and the performance of each electrode was then compared with a potential value in the first hour. The results thereof are summarized in Table 2 below.

TABLE 2

| Category | Example 1 | Example 2 | Example 3 | Example 4 | Example 5 | Comparative Example 1 | Comparative Example 2 |
|---|---|---|---|---|---|---|---|
| Cathode potential (unit: V) | −1.071 | −1.069 | −1.081 | −1.074 | −1.085 | −1.084 | −1.094 |

From the above results, it was confirmed that an effect of improving an overvoltage appeared when a nickel oxide was further included in the coating layer, and, from the comparison between Example 5 and Comparative Example 1, it was confirmed that the nickel component exhibited a similar level of the overvoltage improvement effect even in a smaller amount than platinum.

Experimental Example 2. XPS Analysis of Electrode Coating Layers

Among the electrodes prepared in the examples and the comparative examples, surfaces of the electrodes prepared in Examples 1, 2 and 4 and the electrode prepared in Comparative Example 1 were analyzed by X-ray photoelectron spectroscopy (XPS) to check an amount of each component in the coating layers. The results thereof are presented in Table 3 below.

TABLE 3

| | Example 1 | Example 2 | Example 4 | Comparative Example 1 |
|---|---|---|---|---|
| Ru (%) | 2.3 ± 0.2 | 2.1 ± 0.2 | 2.7 ± 0.9 | 2.3 ± 0.2 |
| Ce (%) | 5.1 ± 0.3 | 3.0 ± 0.5 | 7.2 ± 0.2 | 7.5 ± 0.1 |
| Ni (%) | 5.6 ± 0.5 | 9.0 ± 1.1 | 5.4 ± 1.1 | 1.7 ± 0.3 |
| Pt (%) | 3.6 ± 0.02 | 3.8 ± 0.3 | 3.3 ± 0.2 | 3.4 ± 0.1 |
| C (%) | 41.0 ± 0.7 | 38.1 ± 2.4 | 39.2 ± 1.9 | 45.6 ± 0.9 |
| O (%) | 42.4 ± 0.2 | 44.0 ± 0.9 | 40.3 ± 1.3 | 36.3 ± 0.4 |

From the above results, it was confirmed that the surfaces of the electrodes were smoothly coated with the nickel component in the examples. It is considered that the small amount of the nickel component detected in the comparative example was due to the nickel component of the base.

Experimental Example 3. Durability Evaluation of Electrodes for Electrolysis

A ruthenium oxide in the coating layer of the electrode for electrolysis is converted into metal ruthenium or ruthenium oxyhydroxide ($RuO(OH)_2$) in an electrolysis process, and the ruthenium oxyhydroxide is dissolved in an electrolyte by being oxidized into $RuO_4^{2-}$ in a situation in which a reverse current is generated. Thus, it may be evaluated that the later the reverse current generation condition is reached, the better the durability of the electrode is. From this point of view, after activating the electrodes prepared in the examples, a reverse current generation condition was established, and a change in voltage over time was then measured. Specifically, an electrode size was set to 10 mm×10 mm, and the electrode was activated by electrolysis to generate hydrogen at a current density of −0.1 A/cm$^2$ for 20 minutes, at a current density of −0.2 A/cm$^2$ for 3 minutes, at a current density of −0.3 A/cm$^2$ for 3 minutes, and at a current density of −0.4 A/cm$^2$ for 30 minutes at a temperature of 80° C. in an electrolyte of 32 wt % aqueous sodium hydroxide solution. Thereafter, as the reverse current generation condition, time for the voltage to reach −0.1 V at 0.05 kA/m$^2$ was measured, and relative reach time was calculated based on a commercially available electrode (Asahi-Kasei Corporation). The results thereof are presented in Table 4 below.

TABLE 4

| Category | Reference Example (Asahi-Kasei Corporation) | Example 1 | Example 2 | Example 3 | Example 4 |
|---|---|---|---|---|---|
| −0.1 V reach time | 1 | 8.91 | 8.72 | 4.35 | 3.87 |

From the above results, it was confirmed that the electrodes of the examples of the present invention exhibited excellent durability due to longer time to reach the reverse current than the conventional commercial electrode. Specifically, the electrodes of Examples 1 to 4 all exhibited better durability than the conventional commercial electrode, and, particularly, it may be confirmed that Examples 1 and 2, in which the molar ratio between nickel and cerium was 3:1 to 1:1, exhibited the best durability.

The invention claimed is:

1. A method of preparing an electrode for electrolysis, the method comprising:

applying a coating composition on at least one surface of a metal base; and coating by drying and heat-treating the metal base on which the coating composition has been applied, wherein the coating composition comprises a ruthenium precursor, a cerium precursor, a nickel precursor, and a urea, wherein a molar ratio of the ruthenium precursor to the nickel precursor is in a range of 100:5 to 100:15, and wherein a ruthenium element of the ruthenium precursor and the urea are included in a molar ratio of 100:30 to 100:90.

2. The method of claim 1, wherein the coating composition further comprises a platinum group precursor.

3. The method of claim 2, wherein the platinum group precursor is at least one selected from the group consisting of chloroplatinic acid hexahydrate ($H_2PtCl_6 \cdot 6H_2O$), diamine dinitro platinum ($Pt(NH_3)_2(NO)_2$), platinum(IV) chloride ($PtCl_4$), platinum(II) chloride ($PtCl_2$), potassium tetrachloroplatinate ($K_2PtCl_4$), and potassium hexachloroplatinate ($K_2PtCl_6$).

4. The method of claim 1, wherein the ruthenium precursor is at least one selected from the group consisting of ruthenium hexafluoride ($RuF_6$), ruthenium(III) chloride ($RuCl_3$), ruthenium(III) chloride hydrate ($RuCl_3 \cdot xH_2O$), ruthenium(III) bromide ($RuBr_3$), ruthenium(III) bromide hydrate ($RuBr_3 \cdot xH_2O$), ruthenium iodide ($RuI_3$), and ruthenium acetate.

5. The method of claim 1, wherein the cerium precursor is at least one selected from the group consisting of cerium (III) nitrate hexahydrate ($Ce(NO_3)_3 \cdot 6H_2O$), cerium(IV) sulfate tetrahydrate ($Ce(SO_4)_2 \cdot 4H_2O$), and cerium(III) chloride heptahydrate ($CeCl_3 \cdot 7H_2O$).

6. The method of claim 1, wherein the nickel precursor is at least one selected from the group consisting of nickel(II) chloride, nickel(II) nitrate, nickel(II) sulfate, nickel(II) acetate, and nickel(II) hydroxide.

* * * * *